US006386318B1

(12) United States Patent
Smith

(10) Patent No.: US 6,386,318 B1
(45) Date of Patent: May 14, 2002

(54) J. C. LIFE LADDER

(76) Inventor: Loren E. Smith, 654 E. "E" St., Colton, CA (US) 92324

( * ) Notice: Subject to any disclaimer, the term of this patent is extended or adjusted under 35 U.S.C. 154(b) by 0 days.

(21) Appl. No.: 09/740,185

(22) Filed: Dec. 18, 2000

(51) Int. Cl.[7] ..... E04G 3/00; E06C 1/36
(52) U.S. Cl. ..... 182/97; 182/206
(58) Field of Search ..... 182/93, 107, 214, 182/97, 206, 121, 129, 127, 85, 86, 39, 38; 114/366, 362, 219

(56) References Cited

U.S. PATENT DOCUMENTS

| | | | | | |
|---|---|---|---|---|---|
| 888,383 | A | * | 5/1908 | Asch | 182/39 |
| 4,067,412 | A | * | 1/1978 | Jaclson | 182/93 |
| 4,146,941 | A | * | 4/1979 | Haslam | 182/91 X |
| 4,482,029 | A | * | 11/1984 | Prochaska | 182/96 |
| 4,492,286 | A | * | 1/1985 | Lemire | 182/93 |
| 4,660,677 | A | * | 4/1987 | Hunter | 182/39 X |
| 4,846,303 | A | * | 7/1989 | Cooper et al. | 182/91 X |
| 5,366,052 | A | * | 11/1994 | Keh-Lin | 182/88 |
| 6,105,720 | A | * | 8/2000 | Kumher et al. | 182/127 |
| 6,178,909 | B1 | * | 1/2001 | Palmer | 114/219 |

* cited by examiner

*Primary Examiner*—Daniel P. Stodola
*Assistant Examiner*—Hugh B. Thompson

(57) ABSTRACT

A pivotable type ladder assembly intended primarily as a life saving device for persons who accidentally fall into the water adjacent to the marine structure of a yacht basin or small boat marina. The ladder having two parallel side rails, with upper and lower ends, joined at appropriate intervals by a plurality of perpendicular cross-members, or treads, the bottom most of which is ballasted. The ladder is connected, pivotably; to a mounting bracket suitable for attachment to a marina walkway or docking structure. The bracket having a pivot pin which articulates with a pivot hole positioned in the upper one-third of the ladder and having also at its lower extremity a cross-member to support the ladder while it is in the vertical, deployed position and to prevent side-to-side movement while the ladder is in use. The ladder assembly, including also a stowage cleat positioned so as to support the ballasted lower end of the ladder out of the water at an elevation substantially equal to that of the upper, pivoting end, thus maintaining the ladder in a horizontal position, essentially flat against the side skirt of the marina docking or walkway structure. The ladder being easily dislodged from the cleat is brought by ballast action, automatically, to a secure vertical deployment. Having served its purpose, the ladder may then be rotated easily back onto the stowage cleat.

1 Claim, 4 Drawing Sheets

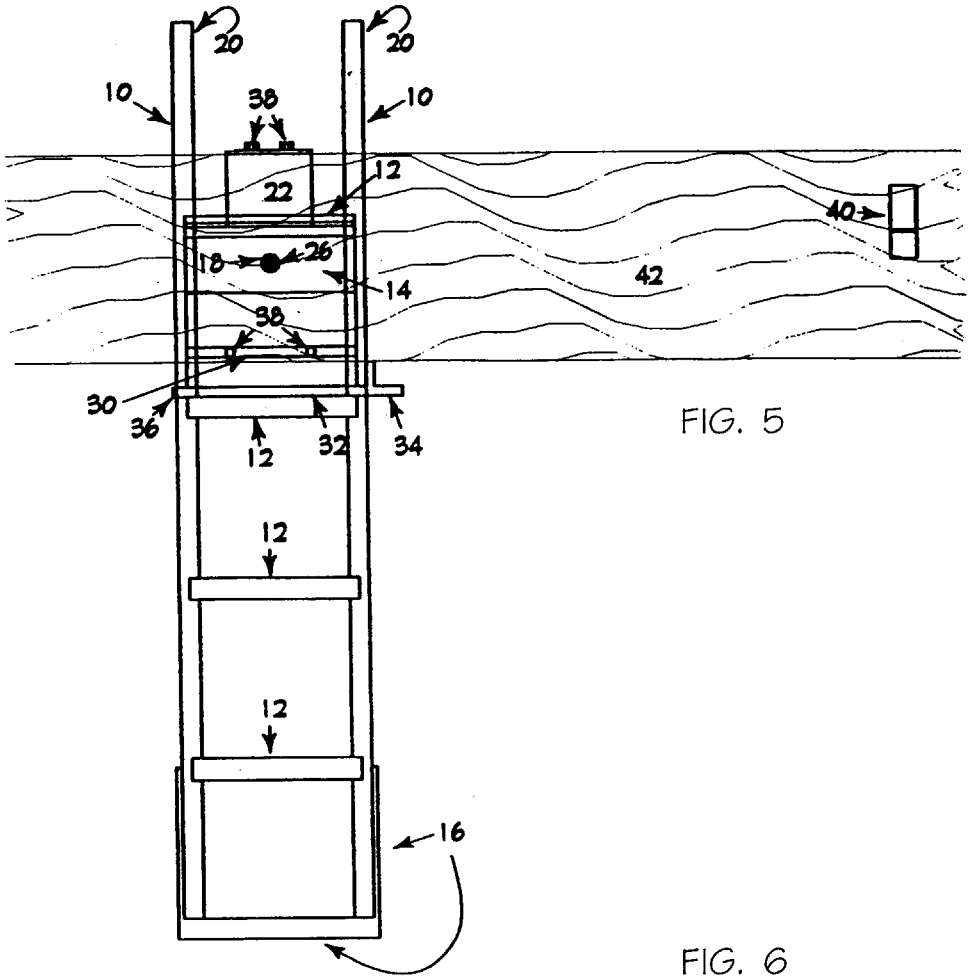
FIG. 5
FIG. 6
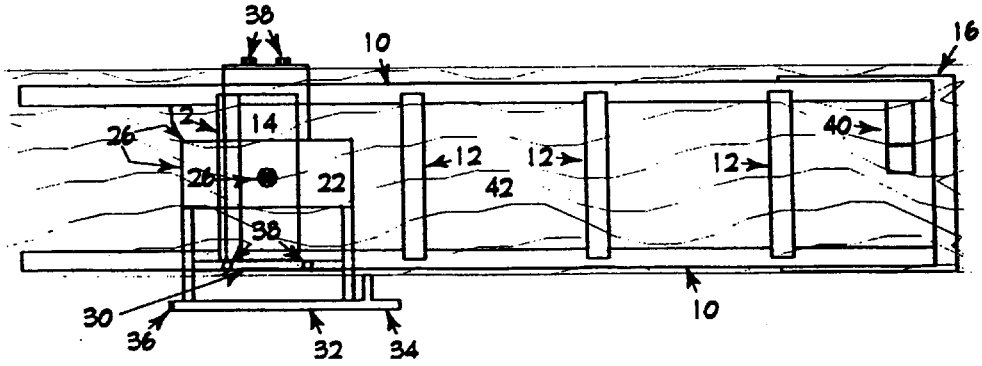

J. C. LIFE LADDER

BACKGROUND—FIELD OF INVENTION

This invention relates to ladders usable as lifesaving equipment for persons who fall into the water from marine structures peculiar to yacht basins or small boat marinas, namely floating docks, walkways, and boat slips.

BACKGROUND—DESCRIPTION OF PRIOR ART

The surface decking of slips, docks, and walkways typical of marinas is generally no more than 15 to 20 inches above the water upon which they float. That spatial relationship, unaffected by tides, remains fairly constant and this tends to reenforce the general perception of marinas as safe havens. Consequently, few life-saving devices are to be found in marinas. For many marina occupants, however, the safe haven can, and has, become a death trap. Young adults in good health with good upper body strength can easily manage an unassisted escape from the water. The typical marina occupant, however, is an older person less physically fit with, perhaps, a child or a grandchild. Such persons are at risk of drowning should they fall into the water and there is no ladder available to them. Absent timely assistance from someone, such persons are in extreme danger of drowning.

Although data are difficult to generate it is beyond doubt that such drownings do occur. The present invention, in fact, was inspired by just such a drowning death on Dec. 24, 1999. The physical evidence at the scene of said drowning made it very clear that the victim had died for lack of a ladder.

The prior art of marine ladders useable as lifesaving equipment for persons who fall into the water are of two basic types: rigid ladders rigidly attached to marine structures, and stowable ladders designed for attachment to boats.

Of the said rigid ladders, most prior art has focused on the problems of large ship-berthing structures which may rise to considerable heights above water level. Several prior art patents combine water exit ladders with fender functions to protect ships' hulls from damage and to transport people between smaller boats, or the water, and elevated docks or quays. Japanese patent no. 55-19383 and U.S. Pat. Nos. 4,494,474 and 4,267,792 combine said ladder and fender functions. The prior art of such large-scale structures appears to have no practical application to such marine structures as are typical of yacht basins and marinas.

Usage in marinas and yacht basins has, for the most part, been to ignore the problem entirely or to rely upon rigid ladders, rigidly attached to selected locations to facilitate escape from the water. Such ladders necessarily remain partially submerged and thus, especially in salt water, become fouled with marine growth which, without periodic maintenance may render them inconvenient, or even unsafe, to use. In the nature of things such periodic maintenance seldom gets done and rigidly fixed ladders of whatever material will almost certainly become a home for a host of sharp-edged and slimy sea growth and, consequently, of marginal reliability as a life ladder.

Of the several marine-type ladders designed for installation on boats, most must be deployed by a person in the boat and are not accessible to a person in the water until they have been so deployed. Such devices are disclosed in U.S Pat. Nos. 4,813,514; 4,768,618; 4,724,925; and 5,117,940.

An exception to the above listed patents is U.S. Pat. No. 4,896,744, which discloses a potentially lifesaving ladder which stows under the decking of a pontoon boat and may be deployed, without assistance, by a person in the water. However, there seems no practical way to install the pontoon boat ladder on the structures appurtenant to the typical yacht basin or small boat marina.

Moreover, ladders which are appurtenant to boats which may or may not be in their slips are not a reliable substitute for safety devices installed as permanent fixtures of the marina environment.

The only prior art patent that is clearly relevant to conditions peculiar to marinas and yacht basins is disclosed in U.S. Pat. No. 4,365,689 filed on behalf of one Francis Dever in February of 1981. Said patent is for a tiltable, portable, pivotable ladder that stows horizontally above the water and may be easily deployed to a vertical position, and is intended to provide the means for unassisted escape from the water to the surface of a marine structure such as a floating dock. Moreover, the device is ballasted so that it will, automatically, return after use to a dry, horizontal stowage position.

It is clear that the Dever invention was aimed at the same problem as that which has inspired the present invention, namely that it is very difficult for persons in the water to escape, unassisted, from the water to the safety of even a relatively low-lying floating dock. Moreover, like the present invention, the Dever ladder stows horizontally out of the water so as to avoid fouling by marine growth, utilizes pivot means to go from stowed, horizontal position to deployed, vertical position; is ballasted; and is deployable from the water by a person unassisted. In all of that, the Dever ladder resembles the present invention. The resemblance, however, is more apparent than real and infinitely less significant than the differences which distinguish it from the present invention. The contrast here is between a workable concept and one which is essentially unworkable. The Denver device is dominated by considerations of portability and automatic function and by pivot means which have an axis that is parallel to the ladder's treads and thus require the ladder to pivot teeter-totter style on the edge of any structure to which it may be attached.

In consequence of said pivot means, the ladder, when in its stowed position, lies with its upper portion flat on the surface of the structure to which it is attached, a hazard to foot traffic; its lower portion protrudes outward over the water, a hazard to boating operations and possibly even swimming traffic.

The pursuit of portability and automatic function, for their part, have resulted in a light-weight ladder device, delicately balanced by means of metal washers serving as the ballast needed to move the ladder from stowage to deployment and back again with very little human involvement. The whole is attachable, ostensibly, by a pair of struts which attach at one end to said pivot means and at the other end are fitted with L-bolts situated so as to grip the edge of the deck planking of a floating dock, secured there by the tightening of wing nuts threaded onto the upper leg of said L-bolt.

The resulting attachment is so inadequate as to border on the whimsical. The weight of even a small child in swim wear, applied to the ladder, suspended as it is from the pivot means at the outer ends of said struts, would almost certainly peel the L-bolt clamping means away from the dock structure and render the ladder useless.

Another consequence of the Dever quest for portability and automatic function is a ladder designed to be relatively small. Drawings of preferred embodiments disclose a ladder having only two treads below the pivot means. The bottom most of these would, therefore, be just at or just below the water's surface. Persons seeking to climb onto a ladder step so near to the water's surface would need to exert considerable strength and ability to do so. For ease of access, the bottom tread of a life ladder should be submerged deeply enough upon deployment as to permit ease of access and require a minimum of physical prowess. This is a consideration of special urgency where the users of such a life ladder are likely to be aging adults and may be wearing water-soaked winter clothing.

Unfortunately, any attempt to lengthen the bottom portion of the Dever ladder would, first of all, be pointless without a more secure attachment means; and secondly, such lengthening would only exacerbate the hazardous condition created by the protruding lower portions of the stored ladder.

SUMMARY OF THE INVENTION

It is the purpose of this invention to provide a life ladder suitable for installation and service in a yacht basin or small boat marina. Accordingly, there is a ladder assembly consisting of three components:

1. A ladder, constructed substantially of wood, having two parallel side rails connected at suitable intervals by a plurality of perpendicular cross-members, or treads. The exact dimensions of the ladder will be dictated by conditions at the installation site but it will have an upper and a lower portion. Appurtenant to said upper portion is the female half of a single point pivot; appurtenant to said lower portion is a ballasted bottom tread. Said pivot and ballast step are both constructed of mild steel and are attached to the wood portions of the ladder with stainless steel screws.
2. A mounting bracket constructed of mild steel and capable of secure attachment to the side skirt of a marina walkway or dock structure with lag bolts or other suitable fasteners and having appurtenant to it the male portion of a single-point pivot by which said ladder and bracket are joined, pivotably, together. Said bracket having also a cross-member at its lower extremity fitted with guides and stops to receive, support, and stabilize the deployed ladder when in use.
3. A stowage cleat attached to the same side skirt as the ladder mounting bracket so as to support the stowed lower end of the ladder at substantially the same elevation as the upper, pivoting end thereof, thus maintaining the stowed ladder in an essentially horizontal position above, and clear of, the water.

Thus installed, the ladder is an unobtrusive, conveniently accessible, and reliable means whereby an unassisted escape from the water can be achieved. Stowed on edge, as it were, the ladder lies flat against the marina structure's side skirt in a plane perpendicular to the water, parallel to the side skirt, and offering no obstacle or hazard to either foot traffic or boating operations. The ladder is easily dislodged from its stowage position by a person in the water. Once dislodged, ballast action causes the ladder to rotate on its single-point pivot. Having an axis perpendicular to the ladder's treads, the pivoting motion is that of the pinwheel rather than the teeter-totter and brings the ladder to a vertical position where it is supported and stabilized by the structure of the mounting bracket without further effort by the person in the water.

Sturdily built and securely attached, the deployed ladder will have a pair of convenient hand holds at its upper end and its ballasted bottom step submerged sufficiently to permit easy access for a person in the water and is well able to support the weight of a large adult dressed in wet winter clothing. Having served its purpose the ladder may be rotated easily back onto its stowage cleat.

BRIEF DESCRIPTION OF DRAWINGS

For the purpose of illustrating the invention, the drawings present the form thereof which is presently preferred. It is to be understood, however, that installation sites are far from uniform and may well require variations of said form, all and any of which shall be without prejudice to the protections sought by this submission.

FIG. 5 presents the ladder mounted and deployed for use;

FIG. 6 shows the ladder mounted and in its stowed position.

REFERENCE NUMERALS IN DRAWINGS

Figure 1:
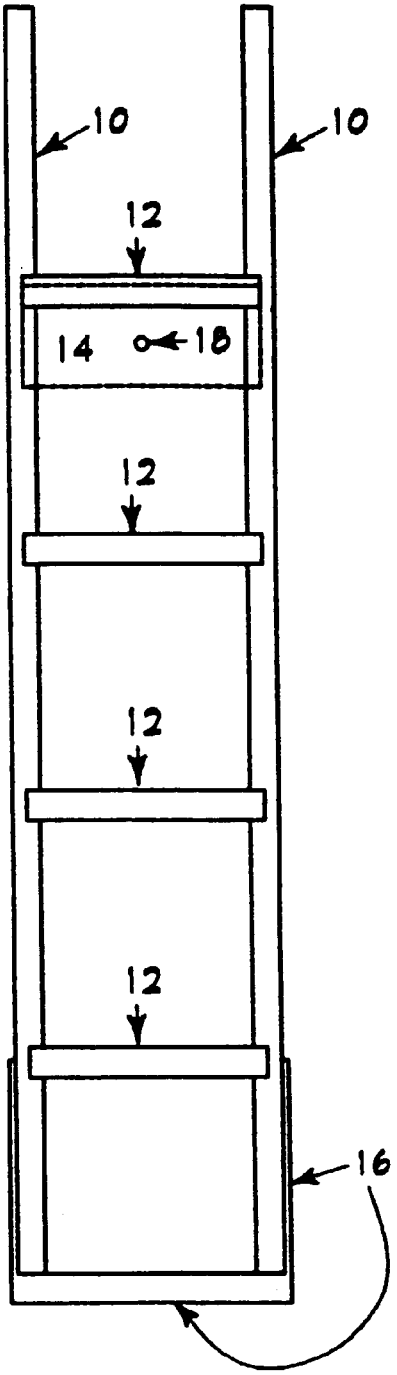
FIG. 1 is a front view of the ladder with its ballast step and female pivot plate.
Figure 2:
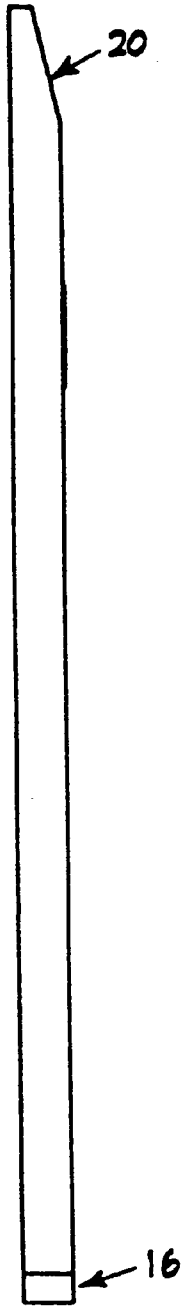
FIG. 2 is a side view showing the tapered top end of the side rails.
Figure 3:
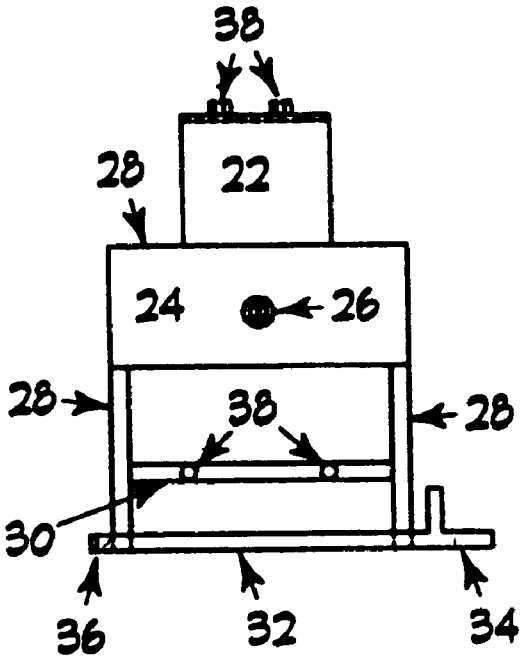
FIG. 3 is a front view of the ladder mounting bracket.
Figure 4:
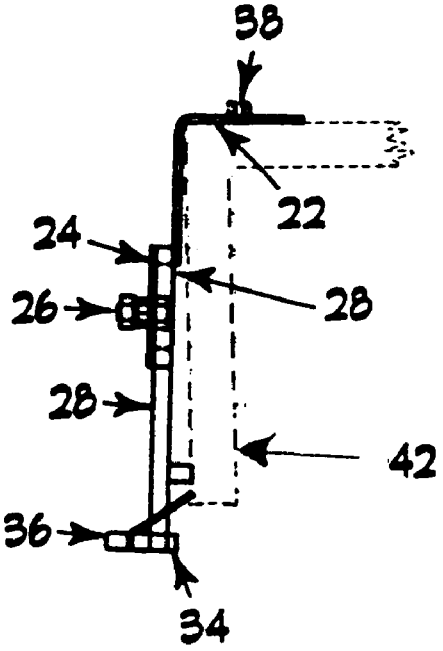
FIG. 4, a side view, shows function of stand-off cross-arm in relieving the severity of a purely vertical climb angle.
Figure 7:
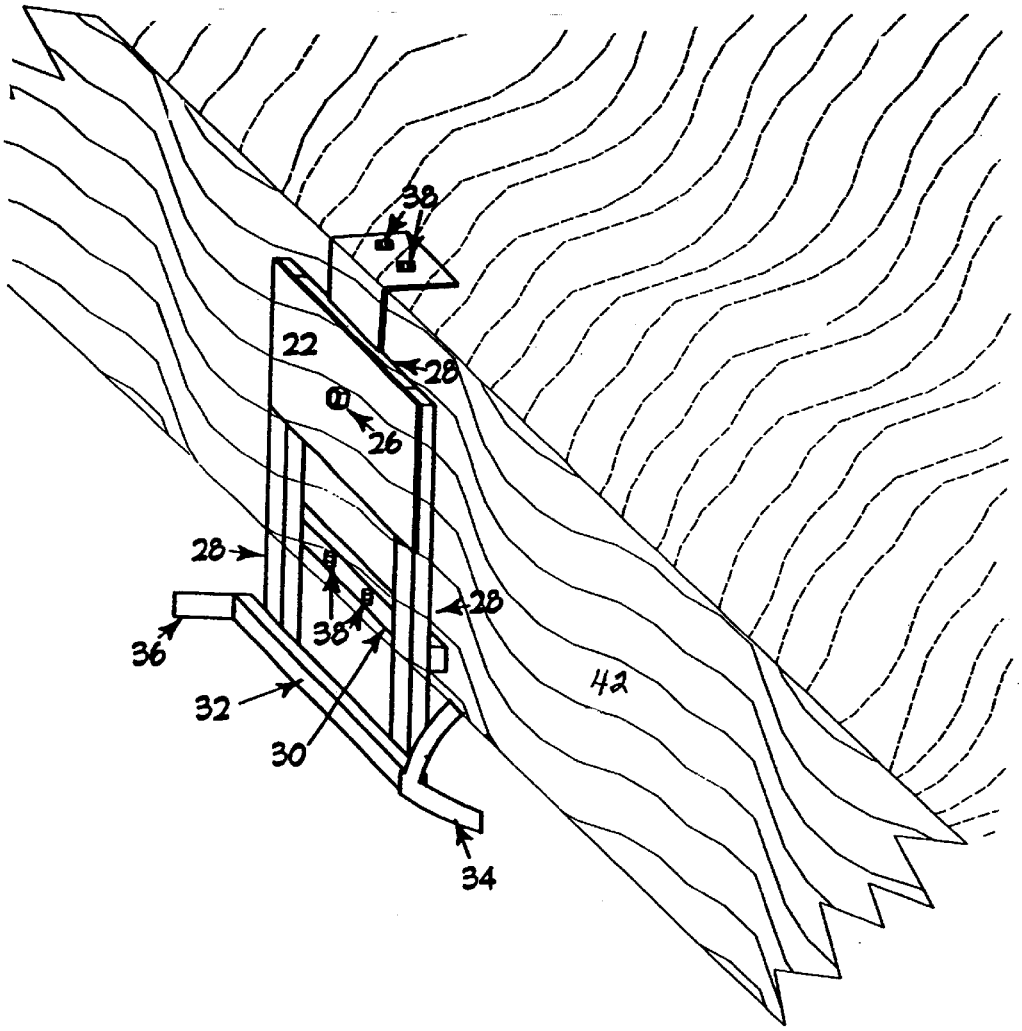
FIG. 7 is an isometric view of the installed mounting bracket from above and to the right.

10. Side rails
12. Cross-member-treads
14. Pivot plate-female
16. Ballast steps
18. Pivot hole
20. Taper hand holds
22. Top mounting flange
24. Pivot plate-male
26. Pivot pin
28. Support frame
30. Stand-off cross-member
32. Ladder support cross-member
34. Ladder support kicker/stop
36. Ladder support stop
38. Lag bolt/fastener
40. Stowage cleat
42. Side skirt of floating dock

DESCRIPTION OF THE PREFERRED EMBODIMENTS

Referring to the drawings in which all like parts are identified by like reference numbers, the marine life ladder of this invention is presented. The ladder has two parallel side rails 10, tapered for convenient hand holds at their top end 20. Side rails and the uppermost four treads 12 are made of construction lumber milled to 1¼" by 2½". A fifth tread 16 is made of steel for its ballast value. Referred to as the ballast step it is attached to the lower end of the side rails 10 with stainless steel screws. Also attached by stainless steel screws to the back of the ladder and just below the top tread is a steel plate 14 drilled at low center with a one-half inch hole 18. Said hole comprises the female half of a single point pivot.

The male portion of said pivot 24 and 26 is an integral part of the ladder mounting bracket. When married to the female portion 14 and 18 a single-point pivot is formed which connects the ladder to the ladder mounting bracket and provides the means whereby the ladder may easily be rotated back and forth between stowage and deployment. The ladder mounting bracket is a welded all metal structure with vertical and horizontal support members 28; an upper mounting flange 22; a stand-off cross-member 30; and a ladder support cross-member 32 equipped with a stop 36 at one end and a pair of flanges, referred to as the kicker 34 at the other end. The structure is attached by lag bolts 38 to the side skirt of a floating marina dock or walkway 42. The stand-off cross-member 30 serves to push the lower portion of the ladder mounting bracket outward from the vertical face of the side skirt 42 and thus provides a more convenient climbing angle to the deployed ladder.

FIGS. 5 and 6 show the installed ladder in both its stowed and deployed positions. It should be noted that in this preferred embodiment the stowed ladder is maintained horizontally above, and clear of, the water and the deployed ladder has approximately half of its five foot length submerged. This arrangement protects the ladder from becoming fouled by marine growth while stowed and puts the deployed bottom ballast step 16 deep enough to provide easy access for a person in the water.

It should be noted also that the tapered hand holds 20 of the deployed ladder rise far enough above the dock's surface to facilitate a climber's access to the safety of the dock. Also, said hand holds provide the leverage needed to easily rotate the deployed ladder back to its stowed position without risk of returning accidentally to the water.

What is claimed is:

1. A mounting bracket support assembly adapted to be rigidly attached to a floating dock having a side surface and a top surface and to which a ladder of appropriate size and strength may be attached pivotally, said assembly comprising an essentially rectangular support frame having two parallel vertical members joined at upper ends thereof by a cross-member coplanar therewith and at lower ends by a second cross-member which is attached to a front surface of said vertical members and extends horizontally beyond said vertical members at both ends whereto are attached stop flanges so as to engage said ladder when deployed for use, and a third cross-member attached to a rear surface of said vertical members, attachable to the side surface and positioned to move the lower end of said support frame away from the side surface, and an upwardly extending hanger plate attached centrally to a rear surface of said first cross-member, said hanger plate being attachable to the top surface whereby said assembly may be attached to the top and side surfaces of said dock, said assembly having also a pivotable ladder attachment comprised of first and second pivot plates, the first plate being attachable to an upper portion of said support frame, the second plate adapted to engage both side rails and at least one rung of said ladder, said plates when joined together by a pivot pin constituting a single pivot point whereby said ladder may be rotated between stowed and deployed positions.

* * * * *